US007501218B2

(12) United States Patent
Guistina et al.

(10) Patent No.: US 7,501,218 B2
(45) Date of Patent: Mar. 10, 2009

(54) ELECTROSTATOGRAPHIC TONER CONTAINING ORGANOMETALLIC DIMETHYL SULFOXIDE COMPLEX CHARGE CONTROL AGENT

(75) Inventors: Robert A. Guistina, Rochester, NY (US); Jason Morgan, Fairport, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 278 days.

(21) Appl. No.: 11/357,233

(22) Filed: Feb. 17, 2006

(65) Prior Publication Data

US 2006/0188801 A1 Aug. 24, 2006

(51) Int. Cl.
*G03G 9/097* (2006.01)

(52) U.S. Cl. ..... 430/108.3; 430/108.5; 430/109.3; 430/109.4

(58) Field of Classification Search ..... 430/108.3, 430/108.5, 109.4, 109.3
See application file for complete search history.

(56) References Cited

U.S. PATENT DOCUMENTS

| | | | | | |
|---|---|---|---|---|---|
| 3,964,903 | A | * | 6/1976 | Van Besauw et al. | 430/108.3 |
| 4,657,838 | A | * | 4/1987 | Fukumoto et al. | 430/108.3 |
| 5,200,288 | A | * | 4/1993 | Ando et al. | 430/108.3 |
| 5,324,613 | A | * | 6/1994 | Ciccarelli et al. | 430/108.3 |
| 5,346,795 | A | * | 9/1994 | Pickering et al. | 430/108.3 |
| 5,368,971 | A | * | 11/1994 | Anzai et al. | 430/108.3 |
| 5,391,453 | A | * | 2/1995 | Ong | 430/108.3 |
| 5,393,632 | A | * | 2/1995 | Ciccarelli et al. | 430/108.3 |
| 5,484,678 | A | * | 1/1996 | Pickering et al. | 430/108.3 |
| 5,571,654 | A | * | 11/1996 | Ong | 430/108.3 |
| 6,552,211 | B2 | * | 4/2003 | Sawano et al. | 556/55 |
| 6,762,004 | B2 | * | 7/2004 | Yamanaka et al. | 430/108.3 |
| 6,835,835 | B1 | | 12/2004 | Huo | |
| 2003/0077534 | A1 | * | 4/2003 | Shiraishi et al. | 430/108.3 |

FOREIGN PATENT DOCUMENTS

| | | |
|---|---|---|
| JP | 61258271 | 11/1986 |
| JP | 63208864 | 8/1988 |
| WO | 92/06414 | 4/1992 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Makino, Takashi; Mizuguchi, Jin. "Crystal structure of solvated zinc complexes based on salicyclic acid", IS&T's NIP20: International Conference on Digital Printing Technologies. (2004) pp. 94-97.*

Shvartsburg, Alexandre, Wilkes, Jon. "Fragmentation Chemistry of DMSO Complexes of Metal Dications" J. Phys. Chem. A vol. 106. (2002), pp. 4543-4551.*

English translation of KR 2002-0094723 (Dec. 18, 2002).*

* cited by examiner

*Primary Examiner*—Christopher RoDee
(74) *Attorney, Agent, or Firm*—Carl F. Ruoff

(57) ABSTRACT

The present invention is an electrostatographic toner that includes an organometallic complex of dimethyl sulfoxide with a metal salt as a charge control agent having the structure;

$$(M^{+n})_x((CH_3)_2SO_2)_y(A^{-q})_z$$

where n, q, x and z are integers between 1 and 6, and y is an integer between 2 and 12, The present invention also includes a developer having a toner, an organometallic complex of dimethyl sulfoxide with a metal salt as a charge control agent having the structure;

$$(M^{+n})_x((CH_3)_2SO_2)_y(A^{-q})_z$$

where n, q, x and z are integers between 1 and 6, and y is an integer between 2 and 12, and a carrier particle.

16 Claims, No Drawings

ELECTROSTATOGRAPHIC TONER CONTAINING ORGANOMETALLIC DIMETHYL SULFOXIDE COMPLEX CHARGE CONTROL AGENT

FIELD OF THE INVENTION

This invention relates to certain new electrostatographic toners and developers containing new organometallic complexes as charge-control agents. More particularly, the compounds yield toners with stable negative polarity and can be dispersed in typical condensation-polymer-type toner binder materials to form the inventive toners having good charging properties without unacceptable interactions with other developer or copier components. Some of the inventive complexes are colorless or low in color rendering them exceptionally useful for color toner applications.

BACKGROUND OF THE INVENTION

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. If the particles do not charge quickly enough, lose their charge, or do not charge to a high enough value then they may fly off the carrier particles in an uncontrolled fashion causing high levels of toner dust in the apparatus. High levels of toner dust can cause severe damage to the electrophotographic apparatus, resulting in contaminated gears, mirrors, lenses etc.

The toner particles in dry developers often contain material referred to as a charge agent or charge-control agent, which helps to establish and maintain toner charge within an acceptable range. Many types of charge-control agents have been used and are described in the published patent literature. Charge control agents may charge toner particle positively or negatively. Charge control agents yielding toner particles with stable positive charge are more ubiquitous than those yielding toners with stable negative charge. In fact, few additives are known which yield toners with stable negative charge. Some of the known negative charge control agents are highly colored rendering them unacceptable for use in anything but black toners. All of the negative charge agents tend to be complex molecules and as such are expensive and add significant expense to the final toner product.

Additionally, some of the known charge agents will adversely interact chemically and/or physically with other developer or copier components. For example, some will interact with carrier or carrier coating materials (e.g., fluorohydrocarbon polymer coatings such as poly(vinylidene fluoride)) and lead to premature carrier aging and shortened useful developer life. Some will chemically interact with certain toner colorants to cause unacceptable hue shifts in the toner. Some being highly colored will be objectionable for use in typical color toners since such a property will also cause objectionable hue shifts. Some will interact with copier fuser rollers (e.g., rollers coated with fluorohydrocarbon polymers such as poly(vinylidene fluoride-co-hexafluoropropylene)) to cause premature failure of the copier's toner fusing system.

It would, therefore, be desirable to provide new dry negative polarity electrographic toners and developers containing charge control agents that perform the charge-controlling function well, while avoiding or minimizing all of the drawbacks noted above. The present invention does this.

SUMMARY OF THE INVENTION

The present invention is an electrostatographic toner that includes an organometallic complex of dimethyl sulfoxide with a metal salt as a charge control agent having the structure;

$$(M^{+n})_x\,((CH_3)_2SO_2)_y\,(A^{-q})_z$$

where n, q, x and z are integers between 1 and 6, and y is an integer between 2 and 12. The present invention also includes a developer having a toner, an organometallic complex of dimethyl sulfoxide with a metal salt as a charge control agent having the structure;

$$(M^{+n})_x\,((CH_3)_2SO_2)_y\,(A^{-q})_z$$

where n, q, x and z are integers between 1 and 6, and y is an integer between 2 and 12, and a carrier particle.

DETAILED DESCRIPTION OF THE INVENTION

The invention provides new dry, particulate, negative polarity electrostatographic toners and developers containing new charge-control agents comprising organometallic complexes of dimethyl sulfoxide with specific metal salts having the general structure:

$$(M^{+n})_x((CH_3)_2SO_2)_y(A^{-q})_z$$

where n, q, x and z are integers between 1 and 6, and y is an integer between 2 and 12.

The inventive toners comprise a polymeric binder and a charge-control agent chosen from the organometallic complexes defined above. The inventive developers comprise carrier particles and the inventive particulate toner defined above.

The organometallic complexes provide good charge-control in the inventive toners and developers. The inventive toners and developers do not exhibit unacceptably high conductivity or environmental sensitivity. The organometallic complexes are quickly, and efficiently dispersed in the inventive toners prepared by melt-blending the salts with appropriate polymeric binders. In the inventive toners and developers, the organometallic complexes have not been found to interact unacceptably with commonly utilized toner colorants, carrier materials, or copier components such as fuser rolls. Additionally, certain colorless or low color organometallic complexes are found to be particularly suited for application in colored toners.

It should be noted that the organometallic complexes employed in the toners and developers of this invention have not been described previously in the patent literature for use as negative polarity charge control agents as applied to electrostatographic toners.

The new organometallic complexes employed in the toners and developers of the invention can be conveniently prepared from readily available starting materials. Common metal salts, the cation of which may be chosen from Groups IB, IIB, IIIB, IVB, VB, or MA, IVA, VA, VIA, VIIA and VIIIA of the periodic table can be combined with dimethylsulfoxide (DMSO) yielding the complexes. An auxiliary solvent may be needed. Cations of aluminum, tin, cobalt and copper are notably preferred. Anions of the metallic cation can be, but are not limited to, sulfate, chloride, nitrate, acetate, lactate. Sulfate and chloride are particularly desirable. To be utilized as a charge-control agent in the electrostatographic toners of the invention, the organometallic complex is mixed in any convenient manner (preferably by melt-blending as described, for example, in U.S. Pat. Nos. 4,684,596 and 4,394,430 with an appropriate polymeric toner binder material and any other desired addenda, and the mix is then ground to desired size to form a free-flowing powder of toner particles containing the charge agent. The final toner can, but is not necessarily, surface treated with a low surface energy component such as derivatized silica or titania.

Toner particles of the invention have an average diameter between about 0.1 μm and about 100 μm, a value in the range from about 1.0 to about 15 μm being preferable for many currently used machines. However, larger or smaller particles may be needed for particular methods of development or development conditions.

Generally, it has been found desirable to add from about 0.05 to about 6 parts and preferably 0.05 to about 2.0 parts by weight of the aforementioned organometallic complex per 100 parts by weight of a polymer to obtain the improved toner composition of the present invention. Although larger or smaller amounts of a charge control agent can be added, it has been found that if amounts much lower than those specified above are utilized, the charge-control agent tends to exhibit little or substantially no improvement in the properties of the toner composition. As amounts more than about 6 parts of charge-control agent per 100 parts of polymeric binder are added, it has been found that the net toner charge exhibited by the resultant toner composition tends to be reduced. Of course, it must be recognized that the optimum amount of charge-control agent to be added will depend, in part, on the particular organometallic complex charge-control agent selected and the particular polymer to which it is added. However, the amounts specified herein above are typical of the useful range of charge-control agent utilized in conventional dry toner materials.

The polymers useful as toner binders in the practice of the present invention can be used alone or in combination and include those polymers conventionally employed in electrostatic toners. Useful polymers generally have a glass transition temperature within the range of from 50 to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful polymers preferably is within the range of from about 65° C. to about 200° C. so that the toner particles can readily be fused to a conventional paper receiving sheet to form a permanent image. Especially preferred polymers are those having a melting point within the range of from about 65 to about 120° C. Of course, where other types of receiving elements are used, for example, metal plates such as certain printing plates, polymers having a melting point and glass transition temperature higher than the values specified above can be used.

Among the various polymers that can be employed in the toner particles of the present invention are polycarbonates, resin-modified maleic alkyd polymers, polyamides, phenol-formaldehyde polymers, and polyester condensates. Polyester binders are a preferred embodiment of the invention. Particularly preferred are polyester condensates of fumaric acid with propoxylated bis-phenol-A.

Additionally, other polyesters having the aforementioned physical properties are also useful. Among such other useful polyesters are copolyesters prepared from terephathalic acid (including substituted terephathalic acid), a bis(hydroxyalkoxy)phenylalkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

We have discovered that the organometallic charge agents of this invention do not function satisfactorily in vinyl-type toner binders. Binders such as styrene-co-butyl acrylate-co-divinylbenzene yielded toners which charge very low and gave very high values of dust when mixed with common carrier materials.

Various kinds of well-known addenda (e.g., colorants, release agents, etc.) can also be incorporated into the toners of the invention. Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2. Second Edition.

Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fushsine N (C.I. 42510), C.I. Basic Blue 9 (C.I. 51015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as toners in the electrostatographic developers of the invention, toners of this invention can be mixed with a carrier vehicle. The carrier vehicles, which can be used with the present toners to form the new developer compositions, can be selected from a variety of materials. Such materials include carrier core particles and core particles overcoated with a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,805,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 5,545,060; 4,478,925; 4,076,857; and 3,970,571. Such polymeric fluorohydrocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition containing the above-described toner and a carrier vehicle generally comprises from about 1 to about 20 percent by weight of particulate toner particles and from about 80 to about 99 percent by weight carrier particles. Usually, the carrier particles are larger than the toner particles. Conventional carrier particles have a particle size on the order of from about 20 to about 1200 microns, preferably 30-300 microns.

Alternatively, the toners of the present invention can be used in a single component developer, i.e., with no carrier particles.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following preparations, measurements, tests, and examples are presented to further illustrate some preferred embodiments of the toners and developers of the invention and the charge agent complexes employed therein, and to compare their properties and performance to those of toners, and developers outside the scope of the invention.

Syntheses of Organometallic Dimethyl Sulfoxide Complexes

Preparation 1

Complex of DMSO with Cobalt Chloride.

3.66 g of cobalt chloride hexahydrate was added to 10 ml reagent grade dimethyl sulfoxide (DMSO). The salt dissolves yielding a deep blue solution. The solution is stirred gently for 24 hours and then is added to 100 ml of reagent grade isopropanol. Fine, blue crystals of the product precipitate. The product is collected by vacuum filtration, washed with cold isopropanol and then vacuum-dried at 60° C. for 16 hours. The yield is 4.31 g. Stoichiometry of the complex is undetermined.

The infrared spectrum of the product was consistent with that of published metal-DMSO complexes.

Preparation 2

Complex of DMSO with Cobalt Sulfate.

3.09 g of cobalt sulfate heptahydrate was added to 10 ml reagent grade dimethyl sulfoxide (DMSO). The salt slowly dissolves yielding a deep purple solution. The solution is stirred gently for 24 hours. A precipitate of pasty pink powder settles from the reaction medium. To the pink suspension is added 100 ml of reagent grade isopropanol. Fine, pink crystals of the product precipitate. The product is collected by vacuum filtration, washed with cold isopropanol and then vacuum-dried at 60° C. for 16 hours. The yield is 2.69 g. Stoichiometry of the complex is undetermined.

The infrared spectrum of the product was consistent with that of published metal-DMSO complexes.

Preparation 3

Complex of DMSO with Tin(IV) Chloride.

3.04 g of tin(IV) chloride pentahydrate was added to 10 ml of distilled water and stirred until dissolution was complete. To the aqueous solution is added 3 ml of reagent grade dimethyl sulfoxide (DMSO). An immediate, copious white precipitate forms from the solution. Precipitation is accompanied by a noticeable exotherm. The product is collected by vacuum filtration, washed with cold ethanol and then vacuum-dried at 60° C. for 16 hours. The yield is 2.89 g. Stoichiometry of the complex is undetermined.

The infrared spectrum of the product was consistent with that of published metal-DMSO complexes.

Preparation 4

Complex of DMSO with Aluminum Nitrate.

3.51 g of aluminum nitrate nonahydrate was added to 10 ml of reagent grade dimethyl sulfoxide (DMSO). An immediate, copious white precipitate forms from the solution. Precipitation is accompanied by a noticeable exotherm. The suspension is stirred for an additional four hours after initial mixing. To the suspension is added 30 ml of isopropanol with good stirring. The product is collected by vacuum filtration, washed with cold isopropanol and then vacuum-dried at 60° C. for 16 hours. The yield is 4.98 g. Stoichiometry of the complex is undetermined.

The infrared spectrum of the product was consistent with that of published metal-DMSO complexes.

Preparation 5

Complex of DMSO with Aluminum Sulfate.

3.58 g of aluminum sulfate octadecylhydrate was added to 30 ml of reagent grade dimethyl sulfoxide (DMSO). The aluminum salt slowly dissolves in the solvent over 24-48 hours. A completely clear solution with very little insoluble matter is obtained. The solution is added to 200 ml of isopropanol with good stirring. A copious, white precipitate of the product forms immediately. The product is collected by vacuum filtration, washed with cold isopropanol and then vacuum-dried at 60° C. for 16 hours. The yield is 3.53 g. Stoichiometry of the complex is undetermined.

The infrared spectrum of the product was consistent with that of published metal-DMSO complexes.

Preparation 6

Complex of DMSO with Iron(III) Chloride.

3.76 g of anhydrous iron(III) chloride was added to 30 ml of reagent grade dimethyl sulfoxide (DMSO). The salt slowly dissolves in the solvent and quickly begins to form a hazy yellow suspension. The suspension is stirred for 16 hours. The suspension is added to 200 ml of isopropanol with good stirring. A copious, yellow precipitate of the product forms immediately. The product is collected by vacuum filtration, washed with cold isopropanol and then vacuum-dried at 60° C. for 16 hours. The yield is 4.66 g. Stoichiometry of the complex is undetermined.

The infrared spectrum of the product was consistent with that of published metal-DMSO complexes.

Preparation 7

Complex of DMSO with Iron(II) Chloride.

3.44 g of iron(II) chloride tetrahydrate was added to 15 ml of reagent grade ethanol The salt slowly dissolves in the solvent. To the ethanolic solution is added 10 ml of reagent grade dimethyl sulfoxide (DMSO). An exotherm is noted, but little precipitation is observed. The ethanol is stripped under a strong stream of nitrogen to yield a rust-colored paste. To the paste is added 15 ml of cold isopropanol with good stirring. The paste solidifies to a rust-colored powder which is collected by vacuum filtration, washed with cold isopropanol and then vacuum-dried at 60° C. for 16 hours. The yield is 2.26 g. Stoichiometry of the complex is undetermined.

The infrared spectrum of the product was consistent with that of published metal-DMSO complexes.

Preparation 8

Complex of DMSO with Iron(III) Nitrate.

2.95 g of iron(III) nitrate nonahydrate was added to 10 ml of reagent grade ethanol. The salt dissolves quickly in the solvent yielding a red-orange solution. To the solution is added 5 ml of reagent grade dimethyl sulfoxide (DMSO). A yellow precipitate forms very rapidly, accompanied by a significant exotherm. The slurry is stirred for an additional hour and then is collected by vacuum filtration, washed with cold ethanol and is vacuum-dried at 60° C. for 16 hours. The yield is 4.72 g. Stoichiometry of the complex is undetermined.

The infrared spectrum of the product was consistent with that of published metal-DMSO complexes.

Preparation 9

Complex of DMSO with Copper(II) Chloride.

1.77 g of copper(II) chloride dihydrate was added to 10 ml of reagent grade ethanol. The salt dissolves quickly in the solvent yielding a dark blue-green solution. To the solution is added 2 ml of reagent grade dimethyl sulfoxide (DMSO). A pale green precipitate forms after 1-2 minutes, accompanied by a significant exotherm. The slurry is stirred for an additional hour and then is collected by vacuum filtration, washed with cold ethanol and is vacuum-dried at 60° C. for 16 hours. The yield is 2.77 g. Stoichiometry of the complex is $CuCl_2$-2(DMSO)[1].

The infrared spectrum of the product was consistent with that of published metal-DMSO complexes.

Preparation 10

Complex of DMSO with Copper(II) Sulfate.

3.19 g of copper(II) sulfate pentahydrate was added to 10 ml of reagent grade dimethyl sulfoxide (DMSO). The salt slowly dissolves in the solvent and slowly begins to form a hazy dark green suspension. The suspension is stirred for 16 hours. To the slurry is added 15 ml of cold reagent grade ethanol. The blue-green product is collected by vacuum filtration, washed with cold ethanol and is vacuum-dried at 60° C. for 16 hours. The yield is 1.34 g. Stoichiometry of the complex is undetermined.

The infrared spectrum of the product was consistent with that of published metal-DMSO complexes.

Preparation of Electrophotographic Toners Containing Organometallic Dimethyl Sulfoxide Complexes Toner Manufacturing The polymer binder used in the invention can be melt processed in a two roll mill or extruder. This procedure can include melt blending of other materials with the polymer, such as toner addenda and colorants. Addenda may also include an alkyl sarcosine or salt thereof if the binder being used was polymerized in its absence. A preformed mechanical blend of particulate polymer particles, colorants and other toner additives can be prepared and then roll milled or extruded. The roll milling, extrusion, or other melt processing is performed at a temperature sufficient to achieve a uniformly blended composition. The resulting material, referred to as a "melt product" or "melt slab" is then cooled. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is cooled and then pulverized to a volume average particle size of from about 5 to 20 micrometers. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

Charge and Dust Measurements

Typically a 4 gram developer sample at 8% toner concentration are prepared by mixing 3.2 g carrier and 0.8 g toner. The developer is mixed on a device that simulates the mixing that occurs in a printer developer station to charge the toner particles. The triboelectric charge of the toner is then measured fresh and aged developer after 10 minutes of mixing using a MECCA device. The MECCA device comprises a set of parallel plate electrodes, spaced 1 cm apart by insulative plastic spacers. A weighed developer sample (typically 0.1 grams) is placed on the lower electrode, which is connected to a power supply typically set to 2000V, with the same polarity as that of the toner to be measured. The upper electrode is connected to a coulomb-meter. The developer sample is magnetically agitated by means of a 60 Hz AC coil positioned under the lower electrode. Developer is agitated in the presence of the electric field, resulting in the toner transferring to the upper plate, where the amount of charge transferred is measured with the coulomb meter. The toner collected is weighed, the measured charge is divided by the measured weight to calculate charge per mass in units of microcoulombs per gram, and the measured weight of toner is divided by the starting weight of developer to calculate the toner concentration.

The amount of dust is measured at the 10-minute level as milligram of toner that dusts off per gram of admixed fresh toner. The developer is subsequently stripped of all toner and rebuilt with fresh toner. The triboelectric charge of the toner is then measured after 2 and 10 minutes of mixing. The amount of dust is again measured at the 10-minute level as mg of toner that dusts off per gram of admixed fresh toner.

In a printer, replenishment toner is added to the developer station to replace toner removed in the process of printing copies. This toner is uncharged and gains a triboelectric charge by mixing with the developer. During this mixing process uncharged or low charged particles can become airborne and result in background on prints or dust contamination within the printer.

A "dusting test" is performed during experimentation to evaluate the potential for a replenishment toner to form background or dust. The 4 g developer sample at 8% toner concentration (3.2 g carrier+0.8 g toner) is exercised on a rotating shell and magnetic core developer station. After 10 minutes of exercising, 0.4 g of fresh uncharged replenishment toner was added to the developer. A fine filter over the developer station then captures airborne dust that is generated when the replenishment toner is added, and the dust collected is weighed as milligrams of dust per 0.4 grams of added replenishment toner. The lower the value for this "dust" measurement corresponds to a better toner performance. Typically, low values of dust (less than 10 milligrams per gram of fresh added toner) in addition to low levels of toner charge (20-41 μm C/g) are desirable.

Results

Toner samples were prepared by melt compounding using the procedure described above. A linear polyester was used as the toner binder. The polyester resin is available from Reichhold Chemicals as Atlac 382ES. The toner resin was mixed with about 3 percent by weight of Pigment Blue 15:3 pigment (available from BASF as Heliogen K7090) and charge agent as indicated in Table 1. In few cases a low molecular weight polyethylene wax from Baker Petrolite was also added. The resulting melt slab was pulverized to yield a particle size in the range of 6 to 7 microns volume average diameter as measured by Coulter Multisizer™.

Developer samples were prepared using a silicone coated carrier using 8 percent by weight of toner. Charge measurement were carried out using MECCA unit of both fresh sample and aged sample. Typical acceptable charge level for this particle size toners ranges between −40 and −60 microcoulomb per grams. Acceptable dusting amounts are less than 20 mgs but higher dusting number are typically observed when the charge is too low. With certain additives, charge of the toner can be adversely affected. For example, with the incorporation of olefinic polymers and hydrophobic silica the toner charge becomes more negative. This is shown in two comparative examples when the charge is almost doubled with the incorporation of Polywax 500. In order to ensure that such additives can be used in toner formulation, the charge of the base toner (without such additives) is lower. When the charge agents of this invention are used, the charge can be easily lowered to any desirable level. As shown in Example 14, the charge has been lowered from −80 to −26 microcoulomb per grams when the charge agents of this invention are used.

The lowering of the charge agent is even observed when the other charge agents are also used in the toner formulation. Therefore, it is possible to control the charge further by mixing a high charging charge agents with low charging charge agents of this invention.

When dusting amounts are compared, the charge agents of this invention show comparable dust even when charges are lower. This would suggest that these charge agents provide high charging rates to the toner.

Results of evaluations of toners containing the inventive charge control agents are summarized in Table 1. Comparison to current commercially available compounds is included in the table as well as examples of organometallic DMSO complexes which do not have acceptable charge control properties. These data exemplify that only certain complexes are suitable to our application and that acceptable performance is unexpected and not predictable.

TABLE 1

| | CCA | pph | Toner Additive | pph | Fresh Charge | Aged Charge | Dust |
|---|---|---|---|---|---|---|---|
| C1 | Orient Bontron E-84 | 2 | | | −18 | −41 | 7.1 |
| C2 | Orient Bontron E-84 | 2 | Baker Petrolite Polywax 500 | 10 | −34 | −80 | 1.3 |
| 1 | CuCl2-2DMSO | 2 | | | −12 | −5 | 107.8 |
| 2 | CuSO4-2DMSO | 2 | | | −11 | −19 | 12.7 |
| 3 | SnCl4-2DMSO | 2 | | | −31 | −19 | 10.4 |
| 4 | Al2(SO4)3-Xdmso | 2 | | | −11 | −20 | 9.9 |
| 5 | FeCl3-Xdmso | 2 | | | −3 | −2 | 172.0 |
| 6 | FeCl2-Xdmso | 2 | | | −2 | −6 | 125.0 |
| 7 | FeCl2-xDMSO | 2 | | | −4 | −4 | 95.5 |
| 8 | Al(NO3)3-xDMSO | 2 | | | −3 | −11 | 122.5 |
| 9 | CoCl2-2DMSO | 2 | | | −12 | −11 | 6.6 |
| 10 | CoSO4-xDMSO | 2 | | | −20 | −27 | 11.5 |
| 11 | Ce(NH4)2 (NO3)6-xDMS | 2 | | | −3 | −14 | 40.9 |
| 12 | Al2(SO4)3.xDMSO)/Hodagaya T-77 | 2/2 | | | −40 | −37 | 2.5 |
| 13 | Al2(SO4)3.xDMSO)/Orient Bontron E-84 | 2/2 | | | −59 | −62 | 0.7 |
| 14 | Al2(SO4)3-xDMSO | 2 | Baker Petrolite Polywax 500 | 10 | −13 | −26 | 8.2 |

The invention has been described in detail with particular reference to certain preferred embodiments thereof, but it will be understood that variations and modifications can be effected within the spirit and scope of the invention.

The invention claimed is:

1. An electrostatographic toner comprising:

a polymeric binder; and an organometallic complex of dimethyl sulfoxide with a metal salt as a charge control agent having the structure:

$$(M^{+n})_x((CH_3)_2SO)_y(A^{-q})_z$$

where $M^{+n}$ represents a metallic cation, $A^{-q}$ represents an anion, n, q, x and z are integers between 1 and 6, and y is an integer between 2 and 12.

2. The electrostatographic toner of claim 1 wherein the dimethyl sulfoxide complex comprises a metal salt having a cation selected from aluminum, tin, cobalt and copper.

3. The electrostatographic toner of claim 2 wherein the metal salt comprises an anion of sulfate, carboxylate, chloride or nitrate.

4. The electrostatographic toner of claim 2 wherein the charge control agent comprises a dimethyl sulfoxide complex of aluminum sulfate.

5. The electrostatographic toner of claim 2 wherein the charge control agent comprises a dimethyl sulfoxide complex of copper sulfate.

6. The electrostatographic toner of claim 2 wherein the charge control agent comprises a dimethyl sulfoxide complex of cobalt (II) sulfate.

7. The electrostatographic toner of claim 2 wherein the charge control agent comprises a dimethyl sulfoxide complex of cobalt (II) chloride.

8. The electrostatographic toner of claim 1 wherein said polymer binder is selected from the group consisting of polycarbonates, resin-modified maleic alkyd polymers, polyainides, phenol-formaldehyde polymers, and polyester condensates.

9. The electrostatographic toner of claim 1 further comprising: colorant materials.

10. The electrostatographic toner of claim 1 further comprising: release agents.

11. The electrostatographic toner of claim 1 wherein the organometallic complex is present in an amount of from 0.05 to 6 parts by weight per 100 parts by weight of the polymeric binder.

12. An electrostatographic developer comprising:

electrostatographic toner comprising a polymeric binder and an organometallic complex of dimethyl sulfoxide with a metal salt as a charge control agent having the structure:

$$(M^{+n})^x((CH_3)_2SO)_y(A^{-q})_z$$

where $M^{+n}$ represents a metallic cation, $A^{-q}$ represents an anion, n, q, x and z are integers between 1 and 6, and y is an integer between 2 and 12; and carrier particles.

13. The electrostatographic developer of claim 12 wherein said polymer binder is selected from the group consisting of polycarbonates, resin-modified maleic alkyd polymers, polyamides, phenol-formaldehyde polymers, and polyester condensates.

14. The electrostatographic developer of claim 12 wherein the dimethyl sulfoxide complex comprises a metal salt having a cation selected from aluminum, tin, cobalt and copper.

15. The electrostatographic developer of claim 14 wherein the metal salt comprises an anion of sulfate, carboxylate, chloride or nitrate.

16. The electrostatographic developer of claim 12 wherein the organometallic complex is present in an amount of from 0.05 to 6 parts by weight per 100 parts by weight of the polymeric binder.

* * * * *

UNITED STATES PATENT AND TRADEMARK OFFICE

CERTIFICATE OF CORRECTION

PATENT NO. : 7,501,218 B2
APPLICATION NO. : 11/357233
DATED : March 10, 2009
INVENTOR(S) : Guistina et al.

It is certified that error appears in the above-identified patent and that said Letters Patent is hereby corrected as shown below:

Cover Page of Patent, Other Publications:
After "Crystal structure of solvated zinc complexes based on" delete "salicyclic" and insert -- salicylic --.

Cover Page of Patent, Abstract:
After "integer between 2 and" delete "12," and insert -- 12. --.

Column 11, claim 8, after "maleic alkyd polymers," delete "polyainides" and insert -- polyamides --.

Column 12, claim 12, delete the chemical structure "$(M^{+n})^x ((CH_3)_2SO)_y (A^{-q})_z$" and insert -- $(M^{+n})_x ((CH_3)_2SO)_y (A^{-q})_z$ --.

Signed and Sealed this

Ninth Day of June, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,501,218 B2
APPLICATION NO. : 11/357233
DATED : March 10, 2009
INVENTOR(S) : Guistina et al.

It is certified that error appears in the above-identified patent and that said Letters Patent is hereby corrected as shown below:

Cover Page of Patent, Other Publications:
After "Crystal structure of solvated zinc complexes based on" delete "salicyclic" and insert -- salicylic --.

Cover Page of Patent, Abstract:
After "integer between 2 and" delete "12," and insert -- 12. --.

Column 11, claim 8, lines 59-60, after "maleic alkyd polymers," delete "polyainides" and insert -- polyamides --.

Column 12, claim 12, line 39, delete the chemical structure "$(M^{+n})^x$ $((CH_3)_2SO)_y$ $(A^{-q})_z$" and insert -- $(M^{+n})_x$ $((CH_3)_2SO)_y$ $(A^{-q})_z$ --.

This certificate supersedes the Certificate of Correction issued June 9, 2009.

Signed and Sealed this

Seventh Day of July, 2009

John Doll

JOHN DOLL
*Acting Director of the United States Patent and Trademark Office*